US005509839A

United States Patent [19]

Liu

[11] Patent Number: 5,509,839

[45] Date of Patent: Apr. 23, 1996

[54] SOFT LUMINESCENCE OF FIELD EMISSION DISPLAY

[75] Inventor: David N. Liu, Chutung, Taiwan

[73] Assignee: Industrial Technology Research Institute, Hsinchu, Taiwan

[21] Appl. No.: 274,416

[22] Filed: Jul. 13, 1994

[51] Int. Cl.[6] ..... H01J 9/227

[52] U.S. Cl. ..... 445/24; 445/49; 313/461; 313/496

[58] Field of Search ..... 445/24, 50, 49; 313/306, 496, 461

[56] References Cited

U.S. PATENT DOCUMENTS

| | | | |
|---|---|---|---|
| 4,164,683 | 8/1979 | Nakamura et al. | 313/496 |
| 4,908,539 | 3/1990 | Meyer | 315/169.3 |
| 5,229,331 | 7/1993 | Doan et al. | 445/50 |

FOREIGN PATENT DOCUMENTS

| | | | |
|---|---|---|---|
| 349425A1 | 1/1990 | European Pat. Off. | 313/496 |

*Primary Examiner*—P. Austin Bradley
*Assistant Examiner*—Jeffrey T. Knapp
*Attorney, Agent, or Firm*—George O. Saile; Stephen B. Ackerman

[57] ABSTRACT

Methods are available for making, and resultant structures of, a field emission display with soft luminescence and a comfortable image for a viewer of the display. The field emission display is formed with a baseplate and an opposing face plate. Field emission microtips are formed in openings in a conductive and insulating layer on the baseplate. An anode is formed on either the faceplate, or on the conductive layer surrounding each opening. Phosphorescent material is formed over the anode. A blocking layer is formed between the phosphor and the faceplate, such that during operation of the display direct light emission from the phosphor is blocked, resulting in indirect phosphorescence and a more comfortable display image. An optional reflective layer may be added over the conductive layer to increase phosphorescence.

6 Claims, 9 Drawing Sheets

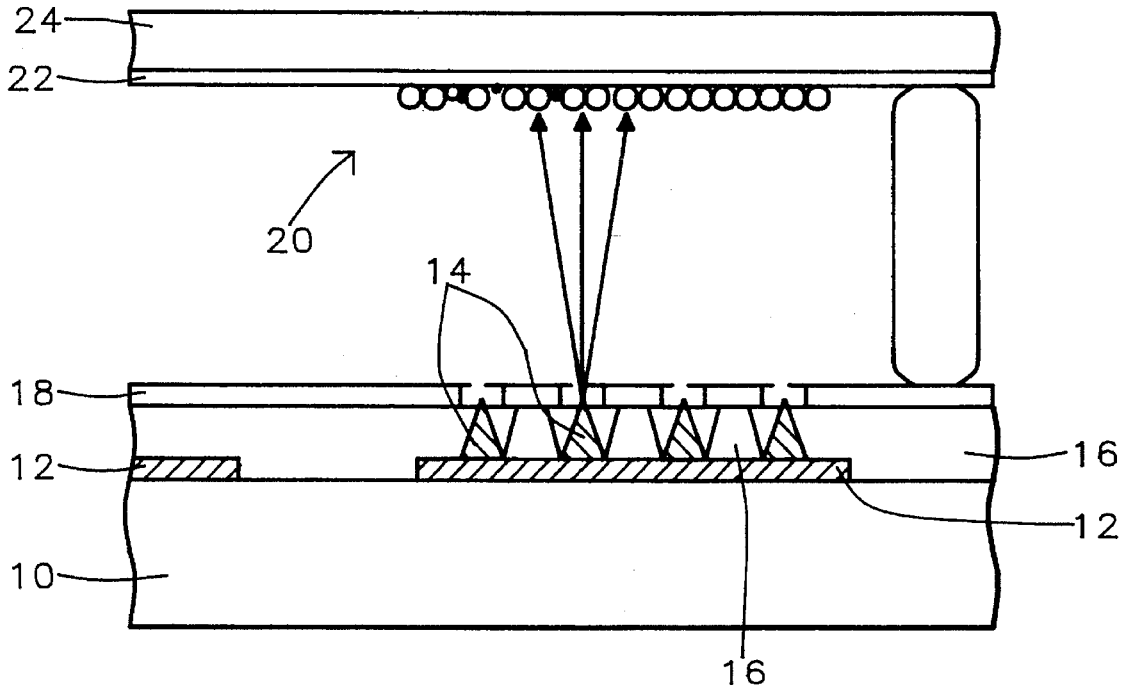
FIG. 1 – Prior Art
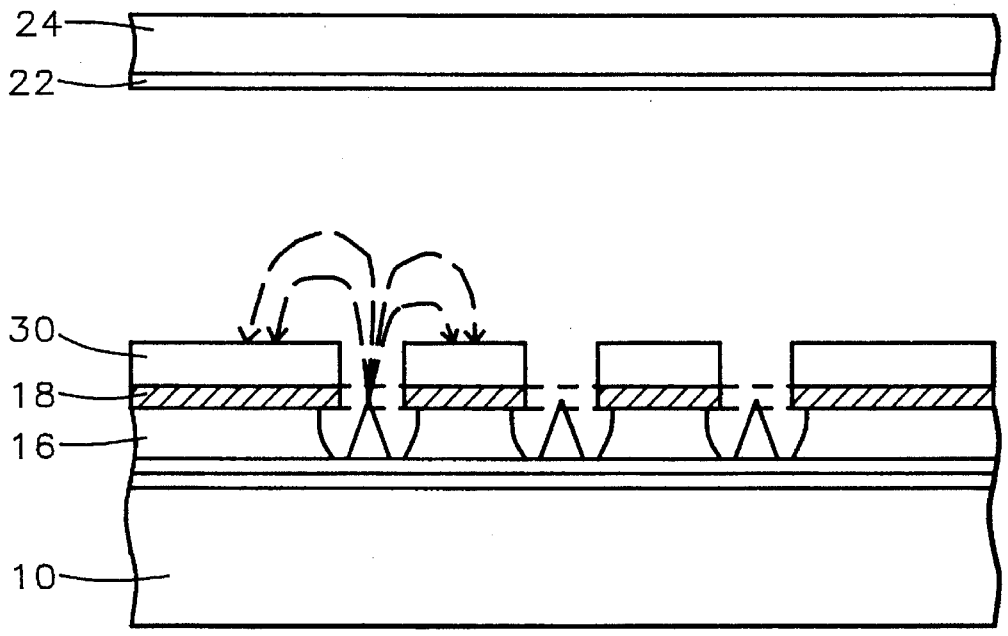
FIG. 2 – Prior Art

SOFT LUMINESCENCE OF FIELD EMISSION DISPLAY

BACKGROUND OF THE INVENTION (1) Field of the Invention

The invention relates to field emission flat panel displays, and more particularly to structures and methods of manufacturing field emission displays that provide soft luminescence for improved end-user viewing characteristics.

(2) Description of the Related Art

In display technology, there is an increasing need for flat, thin, lightweight displays to replace the traditional cathode ray tube (CRT) device. One of several technologies that provide this capability is field emission displays (FED). An array of very small, conical emitters is manufactured, typically on a semiconductor substrate, and can be addressed via a matrix of columns and lines. These emitters are connected to a cathode, and surrounded by a gate. When the proper voltages are applied to the cathode and gate, electrons are emitted and attracted to the anode, on which there is cathodoluminescent material that emits light when excited by the emitted electrons, thus providing the display element. The anode is typically mounted in close proximity to the cathode/gate/emitter structure and the area in between is typically a vacuum.

FIG. 1 is a cross-sectional view of a typical field emission display of the related art. Row electrodes 12 are formed on an insulating baseplate 10, and have emitter tips 14 mounted thereon. The emitters are separated by insulating layer 16. A column electrode 18, or gate, with openings for the emitter tips, is formed on the insulating layer 16 and is formed perpendicular to the row electrodes. When electrons are emitted, they are attracted to conductive anode 22 and upon striking phosphor dot 20, light is emitted, which can be viewed through the transparent faceplate 24. However, the phosphorescence produced by this structure is not comfortable for the viewer of the display, since the light emission is directly at the viewer and the phosphorescence intensity distribution of each pixel is not uniform.

U.S. Pat. No. 4,908,539 to Meyer discloses a change in the location of the phosphor 30, from the faceplate to on top of the column electrode 18, as shown in FIG. 2. This eliminates the light loss in the FIG. 1 structure that occurs as the emitted light passes through the phosphor. Furthermore, alignment of faceplate and baseplate is no longer critical. However, this structure also suffers from the problem of non-uniformity of phosphorescence intensity.

SUMMARY OF THE INVENTION

It is therefore an object of this invention is to provide a field emission display with soft luminescence and a comfortable image for a viewer of the display.

It is a further object of this invention to provide a field emission display which does not require precise alignment of the front and baseplates.

Another object of this invention is to provide a very manufacturable method of fabricating a field emission display with soft luminescence.

A further object of this invention is to provide a very manufacturable method of fabricating a field emission display that does not require precise alignment of the front and baseplates.

These objects are achieved by a field emission display with soft luminescence, having a baseplate and an opposing face plate. A substrate forms the base for the baseplate. There is a layer of insulation over the substrate. Parallel, spaced conductors acting as gate lines for the display, are formed over the layer of insulation. There is a plurality of openings extending through the layer of insulation and the gate lines. At each of the openings is a field emission microtip connected to and extending up from the substrate and into the opening. The faceplate is formed of glass which is mounted opposite and parallel to the baseplate. There is a plurality of parallel, opaque mounting patterns on the faceplate, located opposite to rows of the plurality of openings. There is a a conductive pattern on each of the parallel, opaque mounting patterns, acting as an anode for the field emission display to attract electrons emitted from the field emission microtips. There is a pattern of phosphorescent material over each conductive pattern, whereby when the electrons emitted from the field emission microtips strike the pattern of phosphorescent material, light is emitted. Optionally, a reflective layer may be formed on the gate lines to increase phosphorescence.

These objects are further achieved by a field emission display with soft luminescence, having a baseplate and an opposing face plate, in which the anode and phosphor are formed on the faceplate rather than the baseplate. A substrate acts as a base for the baseplate. There is a layer of insulation over the substrate. Parallel, spaced conductors act as gate lines for the display, formed over the layer of insulation. There is a plurality of openings extending through the layer of insulation and the gate lines. At each of the openings is a field emission microtip connected to and extending up from the substrate and into the opening. There is a first dielectric layer over the gate lines, surrounding each opening. A conductive film on the first dielectric layer, surrounding each opening, acts as an anode for the field emission display to attract electrons emitted from the field emission microtips. Phosphorescent material on the first dielectric layer and between the conductive film and the opening, emits light when the electrons emitted from the field emission microtips attracted to the anodes strike the phosphorescent material. There is a second dielectric layer, separated from the first dielectric layer by the conductive film and the phosphorescent material. The faceplate is formed of glass and is mounted opposite and parallel to the baseplate.

These objects are further achieved by a method of manufacturing a faceplate for a field emission display with soft luminescence, to be mounted opposite to and parallel with a baseplate having a plurality of field emission microtips extending up from a substrate through openings formed in a sandwich structure of an insulating layer and a conductive layer. An opaque layer is formed over a glass plate. The opaque layer is patterned to form parallel patterns. A conductive layer is formed over the parallel patterns and over the glass plate. The conductive layer is patterned to form conductive patterns connected to and having a narrower width than the parallel patterns. Layers of phosphorescent material are formed over the conductive patterns and over the parallel patterns.

These objects are still further achieved by a method of forming a field emission display with soft luminescence. A first insulating layer is formed on a substrate that acts as a baseplate for the field emission display. A first conductive layer is formed over the insulating layer. Openings are formed in the first insulating and first conductive layers. A field emission microtip is formed on the substrate within each of the openings. A second insulating layer is formed over the first conductive layer. A second conductive layer is formed over the second insulating layer. A third insulating layer is formed over the second conductive layer, whereby the openings extend up through the second insulating layer, the second conductive layer and the third conductive layer. An undercut is formed in the second conductive layer, whereby a portion of the third insulating layer, adjacent to the opening, overhangs the undercut. A layer of phosphorescent material is formed within the undercut, over exposed surface of the second conductive layer. A faceplate is mounted over the third insulating layer. Optionally, a reflective layer may be formed over the first dielectric layer and under the conductive film and phosphorescent material, to increase reflection of light from the phosphorescent material through the faceplate during operation of the field emission display.

These objects are still further achieved by another method of forming a field emission display with soft luminescence. A first insulating layer is formed on a substrate that acts as a baseplate for the field emission display. A first conductive layer is formed over the insulating layer. A second insulating layer is formed over the first conductive layer. Openings are formed in the first insulating, first conductive and second insulating layers. A field emission microtip is formed on the substrate within each of the openings. A second conductive layer is formed over the second insulating layer and in the openings, whereby the second conductive material is formed of a different material than the field emission microtip. The second conductive layer is patterned to form an anode surrounding, but separated from, each the opening. A layer of phosphorescent material is formed over each anode. A blocking layer is formed and patterned over the layer of phosphorecent material, whereby during operation of the field emission display the blocking layer prevents direct emission of light through the faceplate. A faceplate is mounted over the blocking layer.

BRIEF DESCRIPTION OF THE DRAWINGS

FIGS. 1 and 2 are cross-sectional representations of prior art field emission microtip structures.

DESCRIPTION OF THE PREFERRED EMBODIMENTS

Referring now to FIGS. 3 to 7, a first method and resultant structure of the invention will be described. A transparent glass faceplate 40 is provided, having a thickness of between about 0.4 and 1.1 millimeters. An opaque material such as titanium oxide, chromium, carbon, lead silicon nitride, or silicon oxide is deposited on the glass by evaporation, sputtering, chemical vapor deposition (CVD) or screen printing. This layer is formed to a thickness of between about 500 and 5000 Å, and patterned by conventional lithography and etching to form parallel, opaque mounting patterns 42.

A conductive film such as chromium, nickel, molybdenum or indium tin oxide (ITO) is next deposited and patterned to form a narrower conductive pattern 44, having a thickness of between about 300 and 3000 Å, over each mounting pattern 42. This will form the anode for the field emission display.

Figure 3:
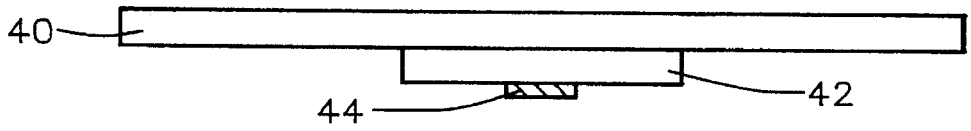
FIGS. 3 to 7 are a cross-sectional representation for one method, and resultant structure, of the invention for forming a field emission display.
Figure 4:
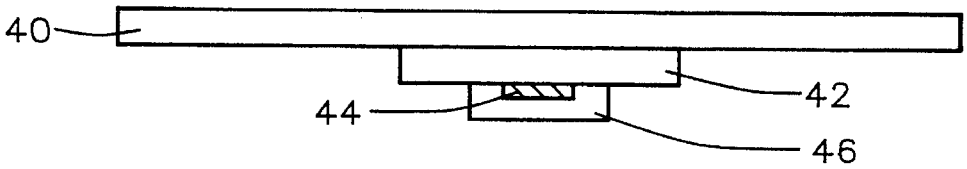

Referring now to FIG. 4, phosphorescent materials 46, having a thickness of between about 0.2 and 10 micrometers, are deposited over the conductive patterns by electrophoresis. A voltage bias is applied to selected ITO patterns. For a color display, three different phosphors are used to emit red, green and blue light. Three distinct electrophoresis steps would thus be required, one for deposition of each phosphor type. Electrophoresis is the motion of charged particles through a suspending medium under the influence of an applied electric field. The plate on which the phosphorescent materials are to be deposited is placed opposite another conductive plate, in a solution in which the materials are suspended and in which these materials are charged by means, for example, of an ionizable electrolyte. The charged phosphorescent materials are attracted to the plate on which they are to be deposited by applying an electric field between the two plates. See U.S. Pat. No. 2,851,408 (Cerulli) for further information. The phosphor 46 is deposited only in the area of the conductive pattern 44 as shown in FIG. 4, and to a thickness of between about 300 and 3000 Å.

Figure 5:
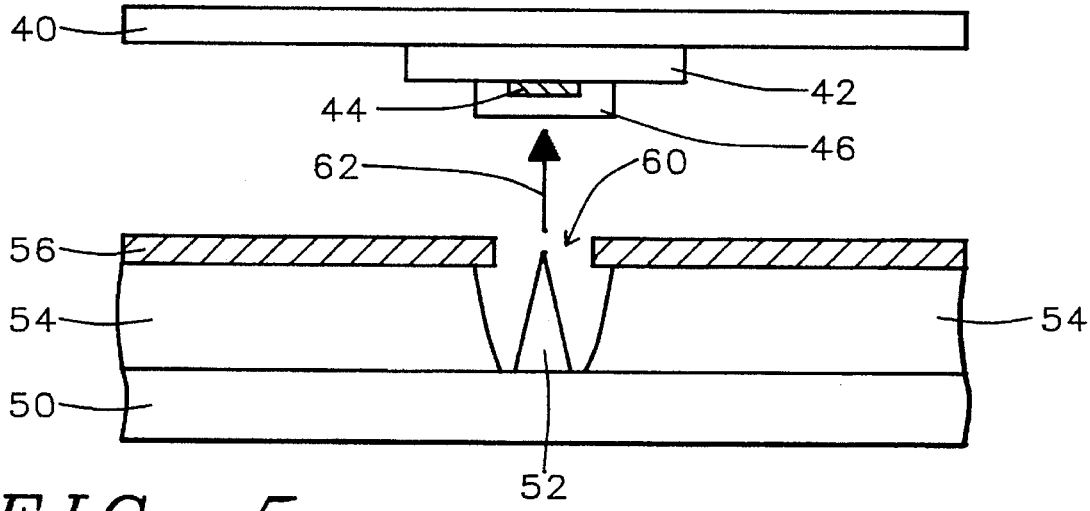

With reference to FIG. 5, the FIG. 4 structure may now be mounted to a baseplate on which has already been formed field emission microtips 52, connected to substrate 50, in an opening 60. The gate, or column electrode, 56 is separated from the substrate by an insulating layer 54 and controls electron emission 62 when a proper voltage bias is applied. The formation of the baseplate and emitters will not be described in detail as it is known in the art and not significant to the invention. Many thousands, or even millions, of microtips are formed simultaneously on a single baseplate in the formation of a field emission display. The faceplate is mounted such that the phosphors and conductive patterns (anode) are directly opposite the field emitter microtips.

Figure 6:
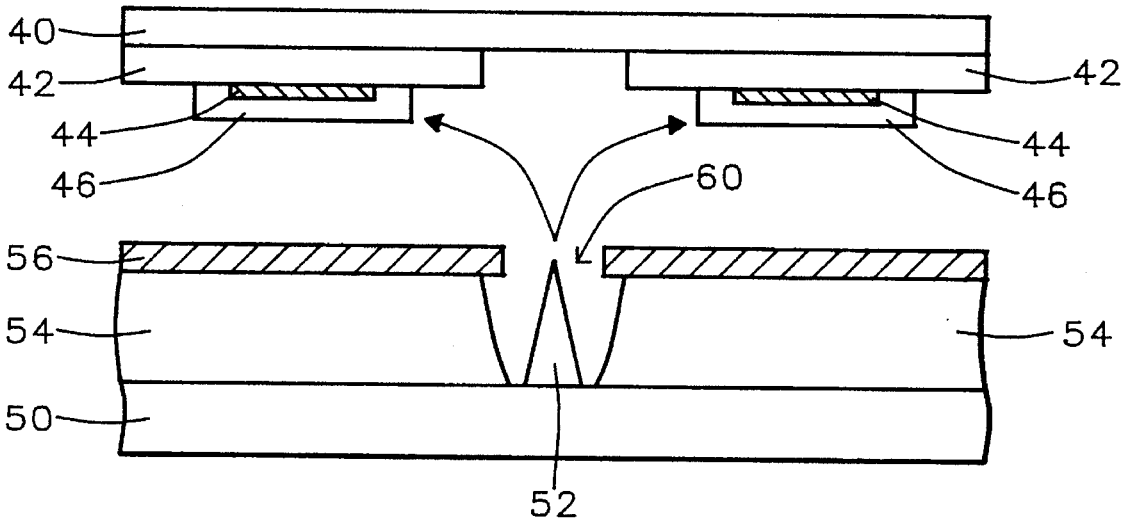
Figure 7:
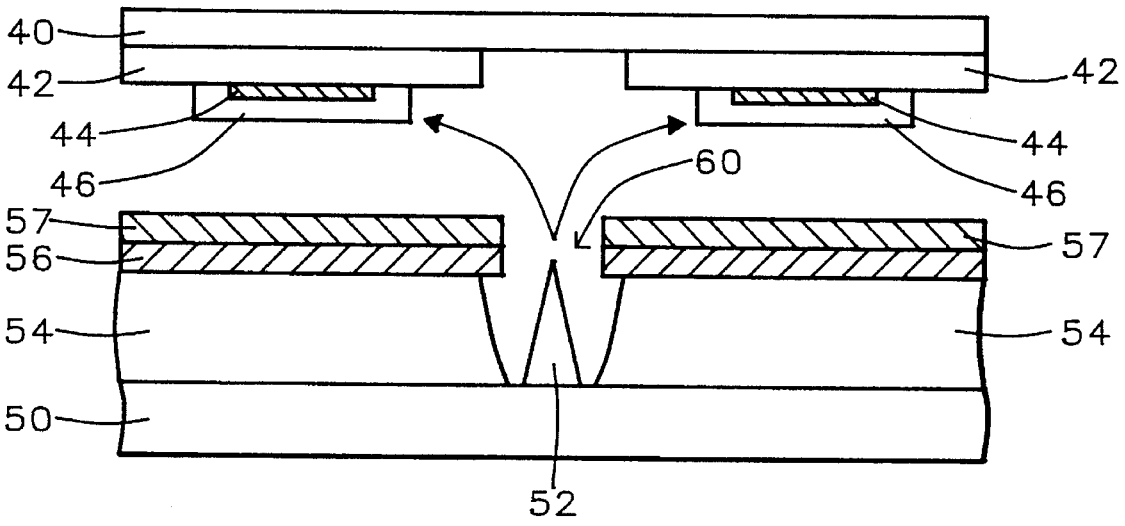

An alternate arrangement of the phosphor/anode patterns is shown in FIG. 6. A pair of phosphors and anodes is opposite each row of emitters, and a roughly equal number of electrons from each emitter impinge on each of the two phosphors. This arrangement provides additional phosphorescence since multiple electron-phosphor collisions occur. When the incident electron impinges one phosphor, a backscattering electron (or secondary emitted electron) is generated and will impinge the other phosphor. Further secondary emission and electron-phosphor collision occur, leading to increased phosphorescence.

in both the FIG. 5 and FIG. 6 structures, an optional reflective layer 57 may be added on top of the conductive gate, as shown in FIG. 7 for the two-phosphor arrangement. This layer is formed of a material that provides a highly reflective surface, such as aluminum or bismuth, to a thickness of between about 500 and 5000 Å. This layer serves to increase the phosphorescence of the display because more light emitted from the phosphor is reflected back at the viewer looking through the faceplate. This layer also serves to reduce the heat generated on the baseplate by reducing light absorption on the baseplate surface.

Figure 8A:
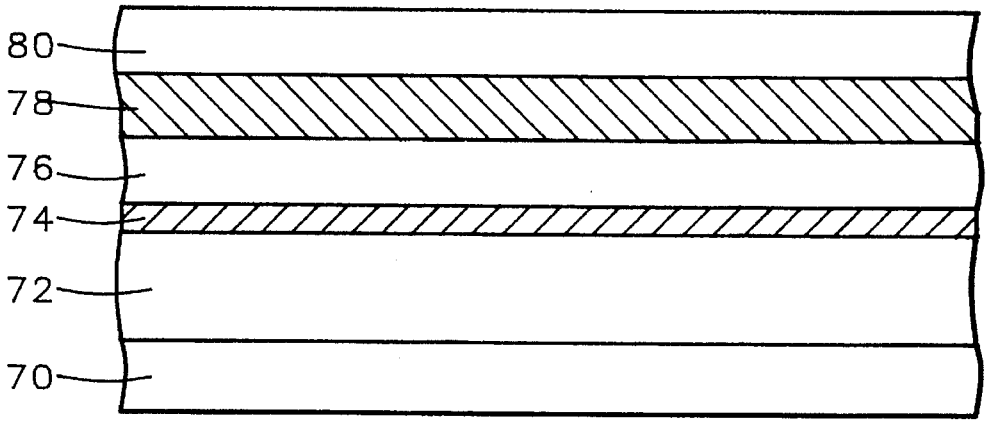
FIGS. 8*a*, 8*b*, 8*c*, 9*a*, 9*b*, and 10 to 13, are a cross-sectional representation for a second method, and resultant structure, of the invention for forming a field emission display.

A second method of the invention and its resultant structure is shown in FIGS. 8*a* through 13. As shown in FIG. 8*a*, an insulating layer 72 of silicon nitride (Si3N4) is formed over the substrate 70, by evaporation, CVD or sputtering, to a thickness of between about 5000 and 10,000 Å. A conductive layer 74 formed of molybdenum is deposited over layer 72, by evaporation or sputtering, to a thickness of between about 500 and 5000 Å. A first dielectric layer 76 is formed, over the conductive layer 74, of silicon oxide (SiO2), by evaporation, sputtering or CVD, to a thickness of between about 5000 and 10,000 Å. A conductive layer 78, which will form the anode, is next formed, by depositing tantalum by evaporation or sputtering, to a thickness of between about 500 and 5000 Å. A second dielectric layer 80 is formed of silicon oxide by evaporation, sputtering or CVD on top of layer 78 to a thickness of between about 5000 and 10,000 Å.

Figure 8B:
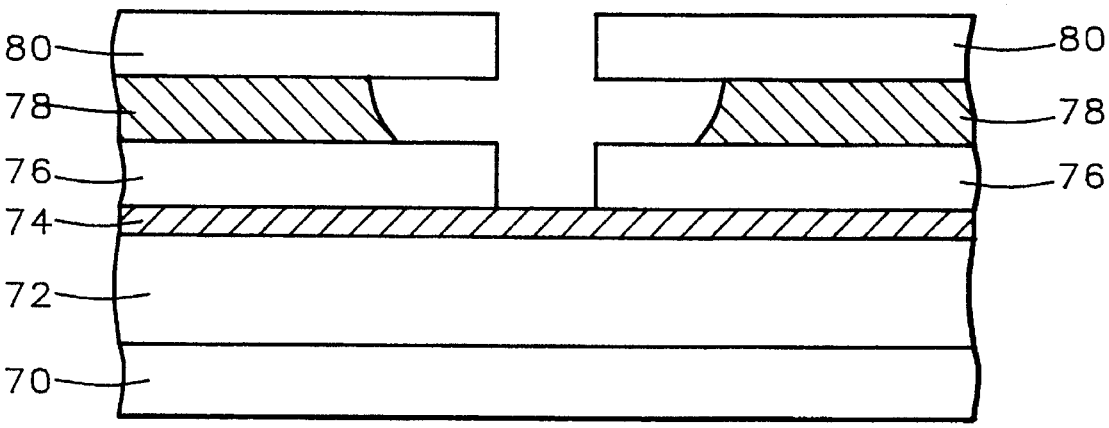

The top four layers are now etched, to provide an opening for formation of the emitter on substrate 70. A photoresist mask (not shown) is formed, by conventional lithography and etching, on layer 80 to define the opening through which the subsequent etching will take place. Layers 80, 78 and 76 are dry etched, as is known in the art, and tantalum layer 78 is then selectively etched back to form an undercut, as shown in FIG. 8b. Layer 74 is then dry etched, and layer 72 wet etched to expose the substrate 70.

Figure 8C:
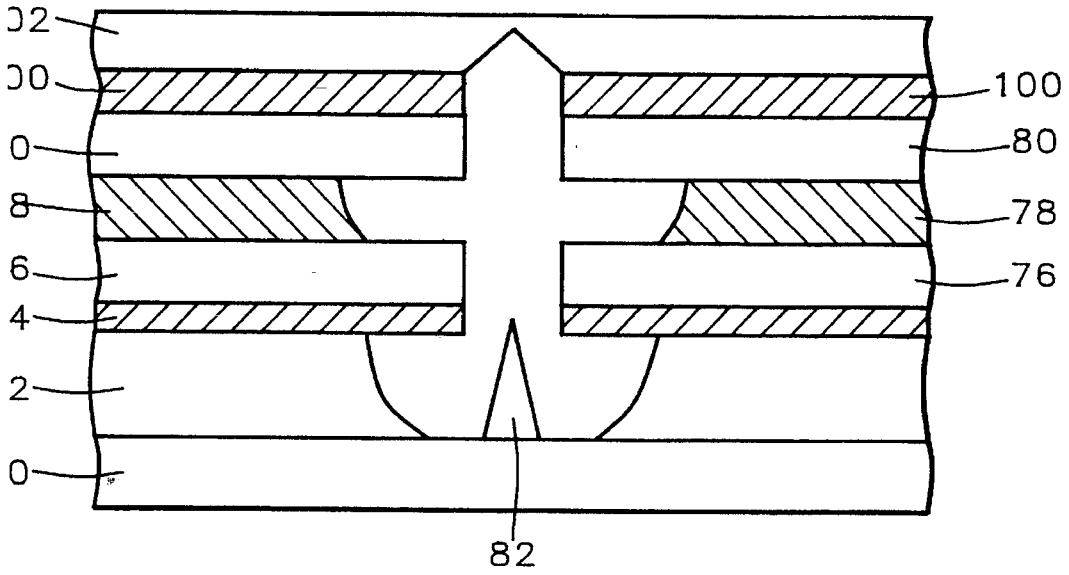

Referring to FIG. 8*c*, the field emission microtip 82 is formed. After removal of the photoresist mask, a sacrificial layer 100 of, for instance, nickel, is deposited by e-beam evaporation using graze angle deposition (to prevent filling of the opening) by tilting the wafer at an angle of 75°. The thickness of this layer is about 1500 Å. A layer 102 of molybdenum is deposited vertically to a thickness of about 18,000 Å, thus forming field emission microtip 82 which is connected to cathode conductor 70 and has a height of between about 12,000 and 15,000 Å. The sacrificial layer 100 and molybdenum 102 are removed by means of wet etching the sacrificial layer.

Figure 9A:
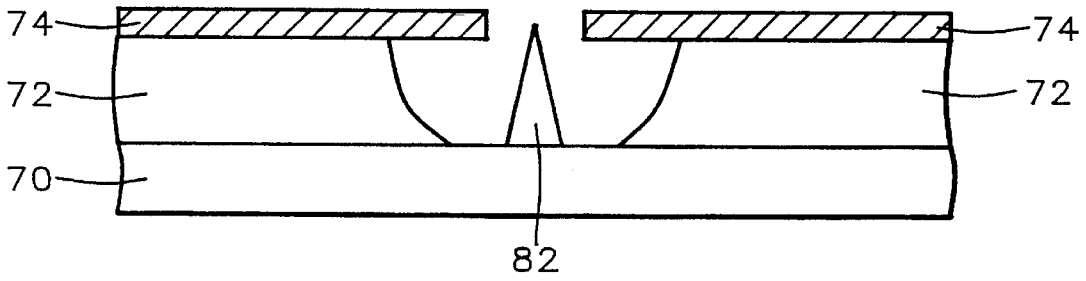
Figure 9B:
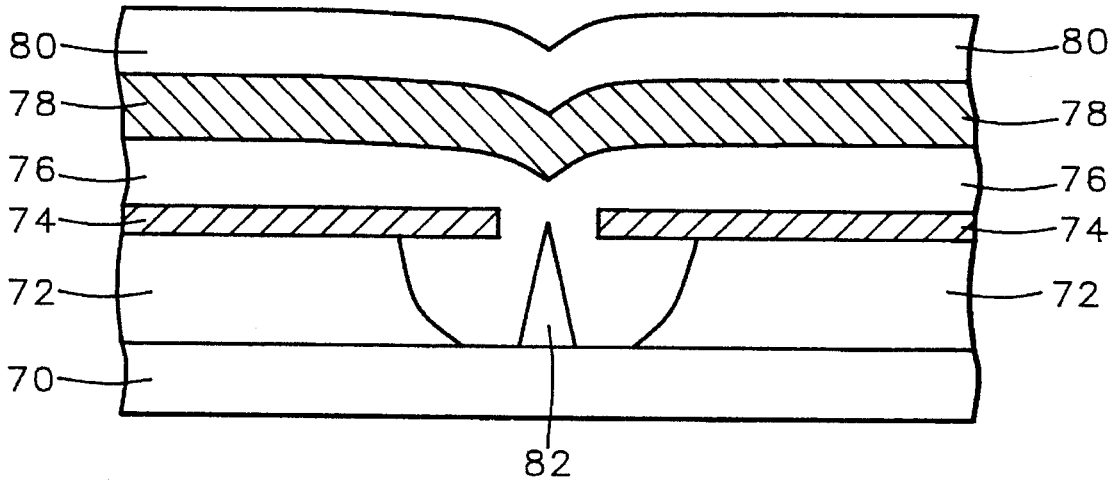

An alternate method for forming the emitter and layered structure is shown in FIGS. 9*a* and 9*b*. As shown in FIG. 9*a*, an emitter 82 has been formed over substrate 70, in an opening in insulator 72 and conductive layer (gate) 74. Layers 72 and 74 are Si3N4 and molybdenum, respectively, and are formed in the same way and to the same thicknesses as in the method of FIGS. 8*a* to 8*c*. These layers are then etched to form the emitter opening, and the emitter formed using graze-angle deposition of a sacrificial layer and vertical deposition of the emitter, also as shown and described above.

Referring now to FIG. 9*b*, a first dielectric layer 76 is formed over the conductive layer 74 and over the emitter, of SiO2, by evaporation, CVD or sputtering to a thickness of between about 5000 and 10,000 Å. A conductive layer 78 which will form the anode is then formed of tantalum, by evaporation or sputtering, to a thickness of between about 500 and 5000 Å. A second dielectric layer 80 is formed of SiO2 by evaporation, CVD or sputtering on top of layer 78, to a thickness of between about 5000 and 10,000 Å.

Layers 80 and 78 are then dry etched, as is known in the art, and tantalum layer 78 is then selectively etched back to form an undercut. Layer 74 is then dry etched, and layer 72 wet etched to expose the substrate 70.

Figure 10:
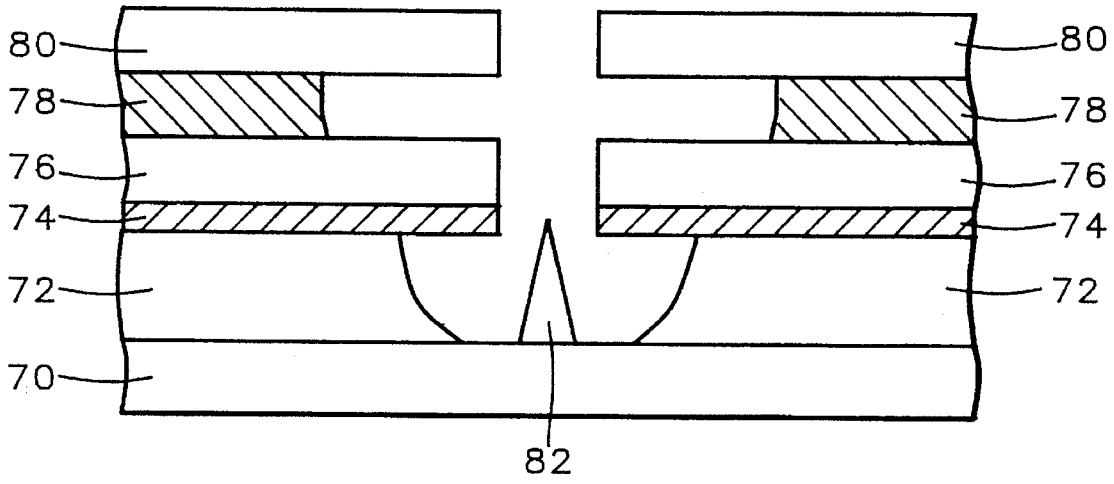

The resultant structure of either of the above two emitter formation methods is shown in FIG. 10.

Figure 11:
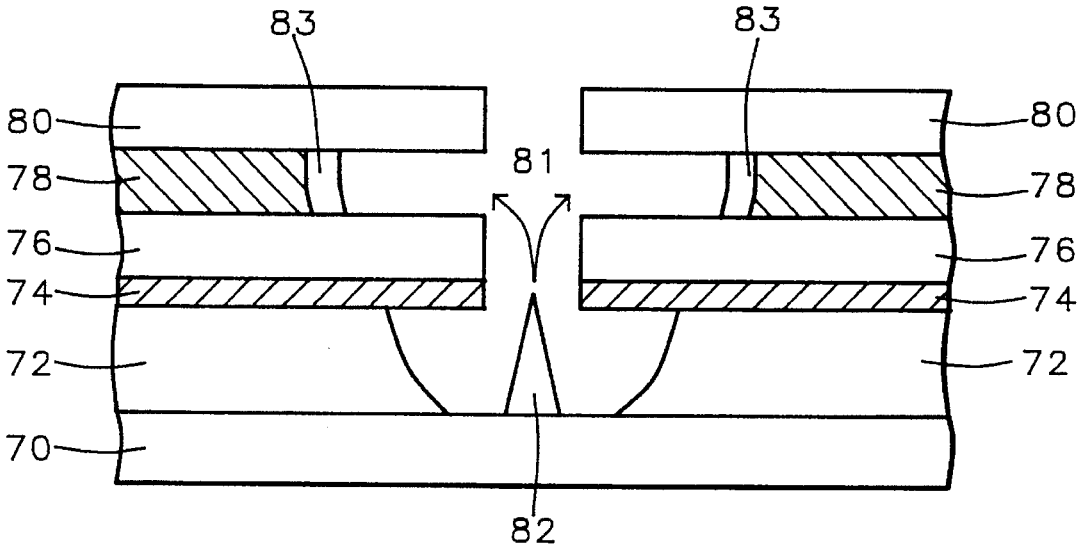

Referring now to FIG. 11, electrophoresis, as described for the first method, is now performed to deposit phosphor 83 on the anode such that during operation of the display, electrons 81 emitted from emitter 82 will be attracted to the anode and will cause light emission upon striking the phosphor 83. Second layer 80 is opaque and will not allow the viewer to see light emission directly from the phosphor.

Optionally, a reflective layer (not shown) may be formed on top of the first dielectric layer 76. As in the first method of the invention, this layer is formed of a material that provides a highly reflective surface, such as aluminum or bismuth, to a thickness of between about 500 and 5000 Å. This layer serves to increase the phosphorescence of the display because more light emitted from the phosphor is reflected back at the viewer looking through the faceplate.

Figure 12:
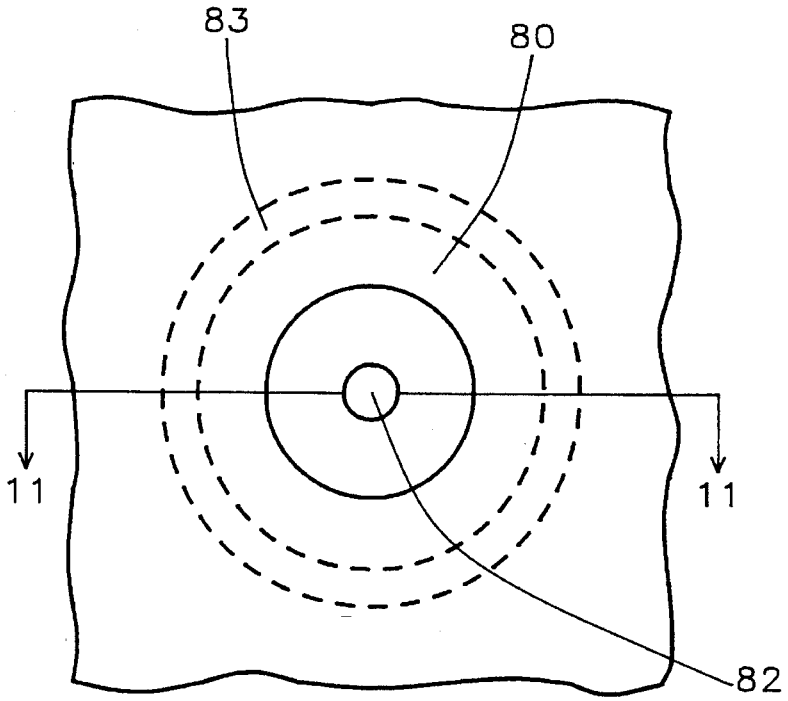

The inner wall of the anode 78, which abuts the outer wall of the phosphor 83, may have a circular shape, as shown in FIG. 12. FIG. 11 is a cross-section though line 11—11 of the top view in FIG. 12. The inner anode wall has a diameter of between about 1 and 12 micrometers. The phosphorescent material has an inner diameter of between about 0.8 and 2.0 micrometers and an outer diameter of between about 1 and 12 micrometers.

Figure 13:
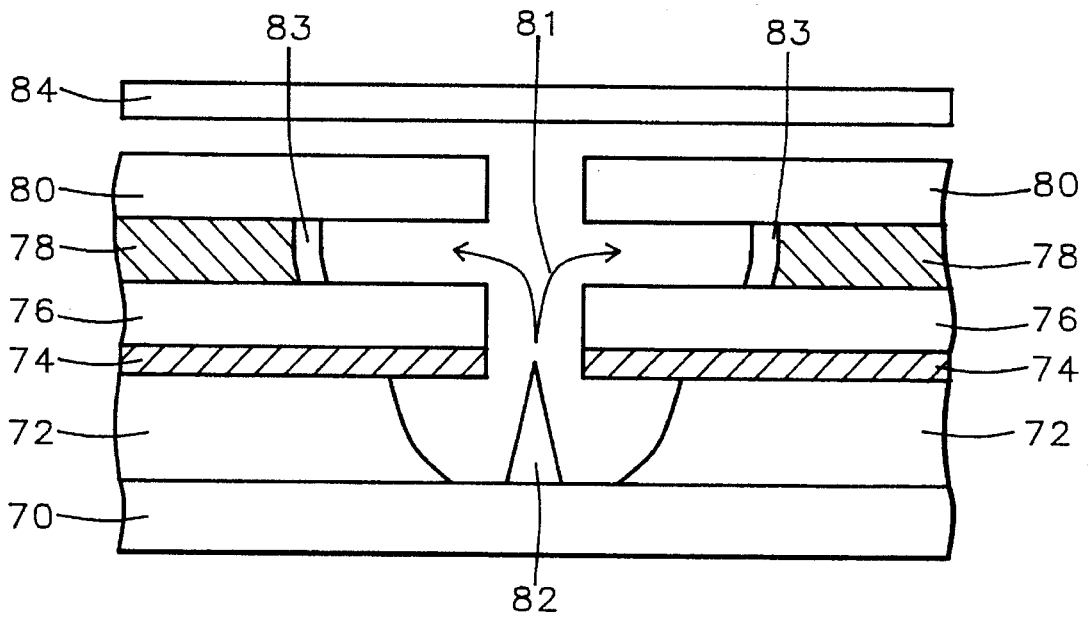

Referring now to FIG. 13, the glass faceplate 84 may now be mounted opposite the emitter/phosphor/anode baseplate structure 85. One advantage of this method of the invention is that the faceplate/baseplate alignment which is critical to the first method for aligning the emitters and the anode, is not critical for this method. The glass faceplate 84 may be separated from the top dielectric layer 80 by spacers, or it may be directly mounted on the top dielectric, to complete the field emission display.

Figure 14:
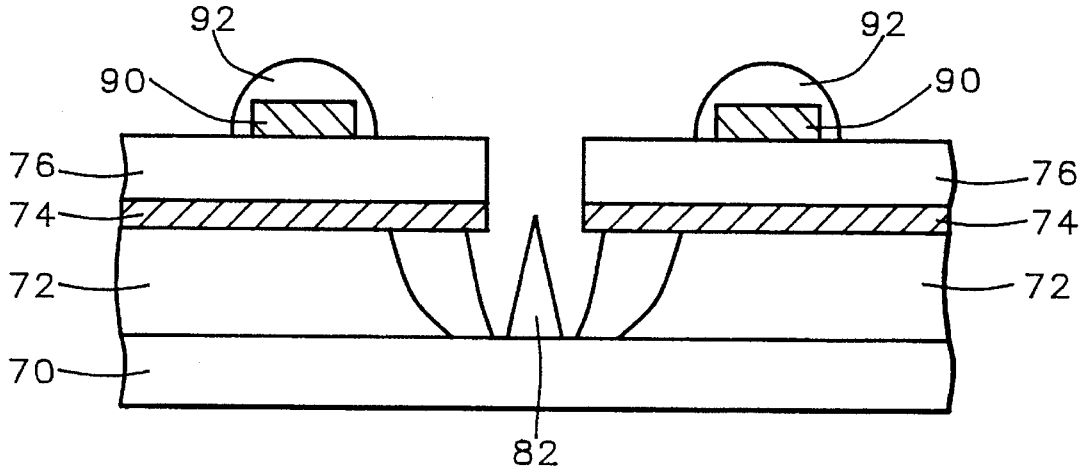
FIGS. 14 to 16 are a cross-sectional representation for an alternate method for forming the second structure of the invention for a field emission display.
Figure 15:
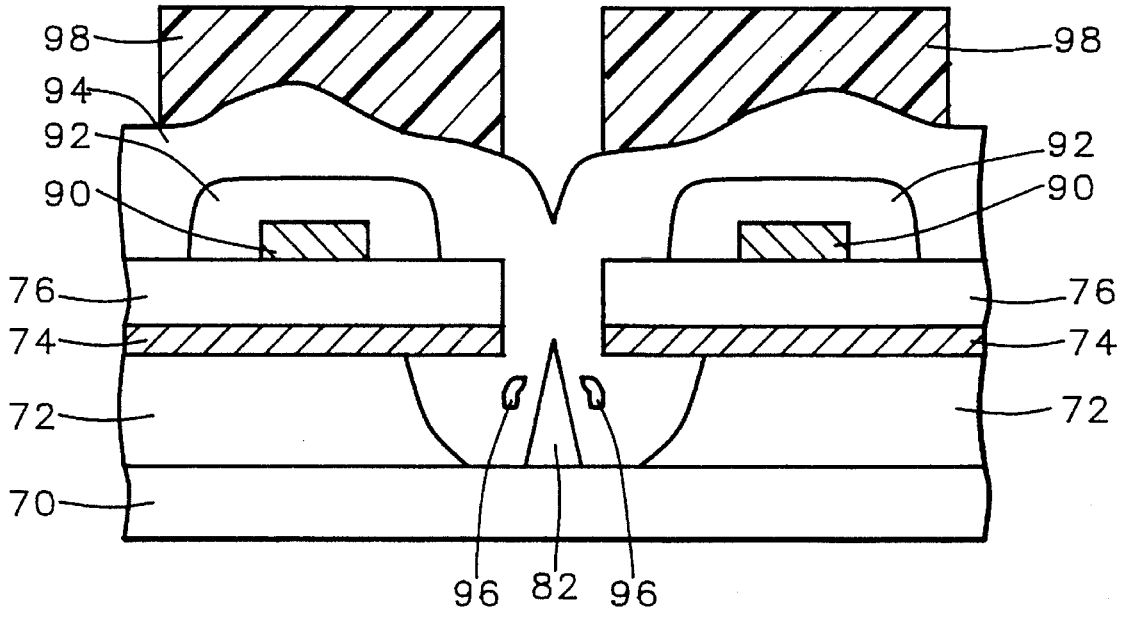
Figure 16:
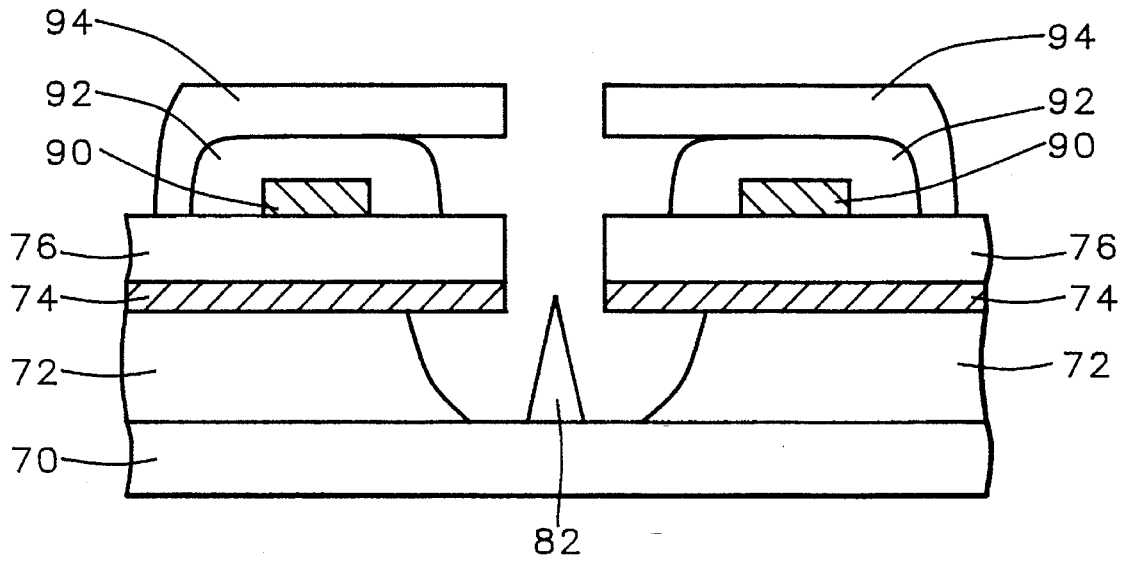

An alternate method for forming the phosphor on gate structure is shown in FIGS. 14 to 16. After formation of the insulator 72, gate 74, first dielectric layer 76 and emitter 82, on substrate 70, as previously described, a layer of conductive material such as ITO, aluminum, chromium, molybdenum or niobium is deposited by evaporation or sputtering to a thickness of between about 500 and 5000 Å, and will be used for the anode. The anode layer material should be different from the emitter material so as to avoid etching the emitter during the anode patterning. The emitter is typically formed of molybdenum or polysilicon. The anode layer is patterned using conventional lithography and etching to form anode 90, so that an anode is formed surrounding, but separated from, each of the emitters 82. Electrophoresis, as described previously, is then performed to deposit phosphor 92 over each anode.

Referring now to FIG. 15, a blocking layer 94 is deposited of chromium, carbon, SiOx, or Si3N4 by CVD, sputtering or evaporation. It is possible that voids 97 may form near the emitter. However, the voids have no detrimental effect. Photoresist 98 is deposited, exposed, developed and etched as shown in FIG. 15 over layer 94. The blocking layer 94 is then etched, as shown in FIG. 16, using the photoresist mask, and the photoresist is removed. This exposes the phosphorous 92. The display is completed by mounting a faceplate (not shown) over the pattern of emitters and anodes. During operation of the display, the blocking layer 94 will prevent direct light emission through the faceplate.

In summary, the method and resultant structures of the invention provide a more comfortable image for a viewer of a field emission display. Opaque phosphorescence blocking material is used to block direct viewing of the light emission by the viewer, so that only reflected phosphorescence is seen and its intensity distribution is uniform.

While the invention has been particularly shown and described with reference to the preferred embodiments thereof, it will be understood by those skilled in the art that various changes in form and details may be made without departing from the spirit and scope of the invention.

What is claimed is:

1. A method of manufacturing a field emission device with a faceplate with soft luminescence, said faceplate to be mounted opposite to and parallel with a baseplate having a plurality of field emission microtips extending up from a substrate through openings formed in a sandwich structure of an insulating layer and a conductive layer, comprising the steps of:

forming an opaque layer over a glass plate;

patterning said opaque layer to form parallel patterns;

forming a conductive layer over said parallel patterns and over said glass plate;

patterning said conductive layer to form conductive patterns connected to and having a narrower width than said parallel patterns; and forming layers of phosphorescent material over said conductive patterns and over said parallel patterns.

2. The method of claim 1 wherein said layers of phosphorescent material are formed by applying a voltage bias to selected said conductive patterns and exposing said conductive patterns to phosphorescent material, using electrophoresis.

3. The method of claim 1 wherein said parallel patterns are formed of titanium oxide to a thickness of between about 500 and 5000 Å.

4. The method of claim 1 wherein said conductive patterns are formed of indium tin oxide deposited to a thickness of between about 300 and 3000 Å.

5. The method of claim 1 wherein said conductive patterns are formed such that when said faceplate is mounted over said baseplate there is one of said conductive patterns directly opposite each row of said field emission microtips.

6. The method of claim 1 wherein said conductive patterns are formed such that when said faceplate is mounted over said baseplate said there is a pair of said conductive patterns opposite each row of said field emission microtips.

* * * * *